US006125986A

United States Patent [19]

Nagase

[11] Patent Number: 6,125,986

[45] Date of Patent: Oct. 3, 2000

[54] SHEET DISCRIMINATING APPARATUS

[75] Inventor: Mitsuhiro Nagase, Tokyo, Japan

[73] Assignee: Laurel Bank Machines Co., Ltd., Tokyo, Japan

[21] Appl. No.: 09/184,360

[22] Filed: Nov. 2, 1998

[30] Foreign Application Priority Data

Nov. 10, 1997 [JP] Japan ..... 9-307650
Oct. 29, 1998 [JP] Japan ..... 10-307991

[51] Int. Cl.[7] ..... G07D 7/12

[52] U.S. Cl. ..... 194/207; 250/556

[58] Field of Search ..... 194/207; 250/556; 356/71

[56] References Cited

U.S. PATENT DOCUMENTS 5,448,502 9/1995 Kindo et al. ..... 364/526
5,757,001 5/1998 Burns ..... 250/339.11

FOREIGN PATENT DOCUMENTS 2-71394 9/1990 Japan .

*Primary Examiner*—F. J. Bartuska
*Attorney, Agent, or Firm*—Frishauf, Holtz, Goodman, Langer & Chick, P.C.

[57] ABSTRACT

A sheet discriminating apparatus includes a light source for emitting light toward a sheet, a spectrophotometer for receiving light emitted from the light source and reflected by a non-printed surface portion of the sheet and generating spectral data, a memory for storing reference data, and a discriminator for discriminating genuineness of the sheet based on the spectral data generated by the spectrophotometer and the reference data stored in the memory. According to the thus constituted sheet discriminating apparatus, it is possible to accurately discriminate the genuineness of a sheet, particularly a bill or security certificate.

20 Claims, 7 Drawing Sheets

SHEET DISCRIMINATING APPARATUS

BACKGROUND OF THE INVENTION

The present invention relates to a sheet discriminating apparatus and, in particular, to such an apparatus which can accurately discriminate the genuineness of a sheet, particularly a bill or security certificate.

DESCRIPTION OF THE PRIOR ART

The improved performance of color copying machines and color printers has prompted the development of various sheet discriminating apparatuses capable of accurately discriminating counterfeit bills and/or security certificate and one such apparatus is a sheet discriminating apparatus which optically discriminates the genuineness of a sheet by irradiating it with light and detecting light reflected from the sheet.

For example, Japanese Patent Application Laid Open No. 2-71394 discloses a bill discriminating apparatus comprising a color sensor having a green light detecting element and a red light detecting element and discriminating means adapted to discriminate the genuineness of a bill and bill denomination by receiving output currents obtained by detecting only green components contained in light reflected from the bill by the green light detecting element and output currents obtained by detecting only red components contained in light reflected from the bill by the red light detecting element, converting them into voltages, calculating the difference therebetween and comparing the thus obtained voltage difference with reference data.

However, since the genuineness of a bill and bill denomination are discriminated based on the difference between the green components and the red components contained in light reflected from the bill in this bill discriminating apparatus, if the difference between green components and red components contained in light reflected from a bill counterfeited using a color copying machine or a color printer does not greatly differ from that of a genuine bill, a counterfeit bill will sometimes be discriminated as a genuine bill. It is, therefore, impossible to discriminate the genuineness of bills with high accuracy.

SUMMARY OF THE INVENTION

It is therefore an object of the present invention is to provide a sheet discriminating apparatus which can accurately discriminate the genuineness of a sheet, particularly a bill or security certificate.

The above other objects of the present invention can be accomplished by a sheet discriminating apparatus comprising a light source for emitting light toward a bill, light receiving means for receiving light emitted from the light source and reflected by a non-printed surface portion of the bill and generating spectral data, memory means for storing reference data, and discriminating means for discriminating genuineness of the bill based on the spectral data generated by the light receiving means and the reference data stored in the memory means.

In a preferred aspect of the present invention, the light receiving means is constituted so as to store in advance spectral data of a genuine bill as reference spectral data, generate detected data by dividing intensity data of the spectral data of the bill at each wavelength by intensity data of the reference spectral data at the corresponding wavelength and output the detected data to the discriminating means, and the discriminating means is constituted so as to compare the detected data with the reference data stored in the memory means, thereby discriminating the genuineness of the bill.

In a further preferred aspect of the present invention, the discriminating means comprises chromaticity coordinate conversion means for converting the detected data into chromaticity coordinates and distance calculating means for calculating a distance between a point represented by the chromaticity coordinates of the detected data converted by the chromaticity coordinate conversion means and the origin of the chromaticity coordinate system and is constituted so as to discriminate the genuineness of the bill based on the distance between the point represented by the chromaticity coordinates of the detected data converted by the chromaticity coordinate conversion means and the origin of the chromaticity coordinate system.

In another preferred aspect of the present invention, the light receiving means is constituted so as to store in advance reference spectral data, generate detected data by dividing intensity data of the spectral data of the bill at each wavelength by intensity data of the reference spectral data at the corresponding wavelength and output the detected data to the discriminating means, and the discriminating means comprises chromaticity coordinate conversion means for converting the detected data into chromaticity coordinates and is constituted so as to discriminate the genuineness of the bill based on the chromaticity coordinates of the detected data converted by the chromaticity coordinate conversion means and the chromaticity coordinates of reference detected data obtained by dividing intensity data of spectral data of a genuine bill at each wavelength by intensity data of the reference spectral data at the corresponding wavelength.

In a further preferred aspect of the present invention, the discriminating means further comprises distance calculating means for calculating a distance between a point represented by the chromaticity coordinates of the detected data converted by the chromaticity coordinate conversion means and a point represented by the chromaticity coordinates of reference detected data and is constituted so as to discriminate the genuineness of the bill based on the distance between the point represented by the chromaticity coordinates of the detected data and the point represented by the chromaticity coordinates of reference detected data calculated by the distance calculating means.

In a further preferred aspect of the present invention, the discriminating means further comprises reference polar coordinate conversion means for converting the chromaticity coordinates of the reference detected data into polar coordinates, polar coordinate conversion means for converting the chromaticity coordinates of the detected data converted by the chromaticity coordinate conversion means into polar coordinates, and comparing means for discriminating the genuineness of the bill based on the polar coordinates of the reference detected data converted by the reference polar coordinate conversion means and the polar coordinates of the detected data converted by the polar coordinate conversion means.

In a further preferred aspect of the present invention, the light receiving means is constituted as a spectrophotometer.

In a further preferred aspect of the present invention, the sheet is selected from a group consisting of a bill and security certificate.

The above and other objects and features of the present invention will become apparent from the following description made with reference to the accompanying drawings.

DESCRIPTION OF THE PREFERRED EMBODIMENT

Figure 1:
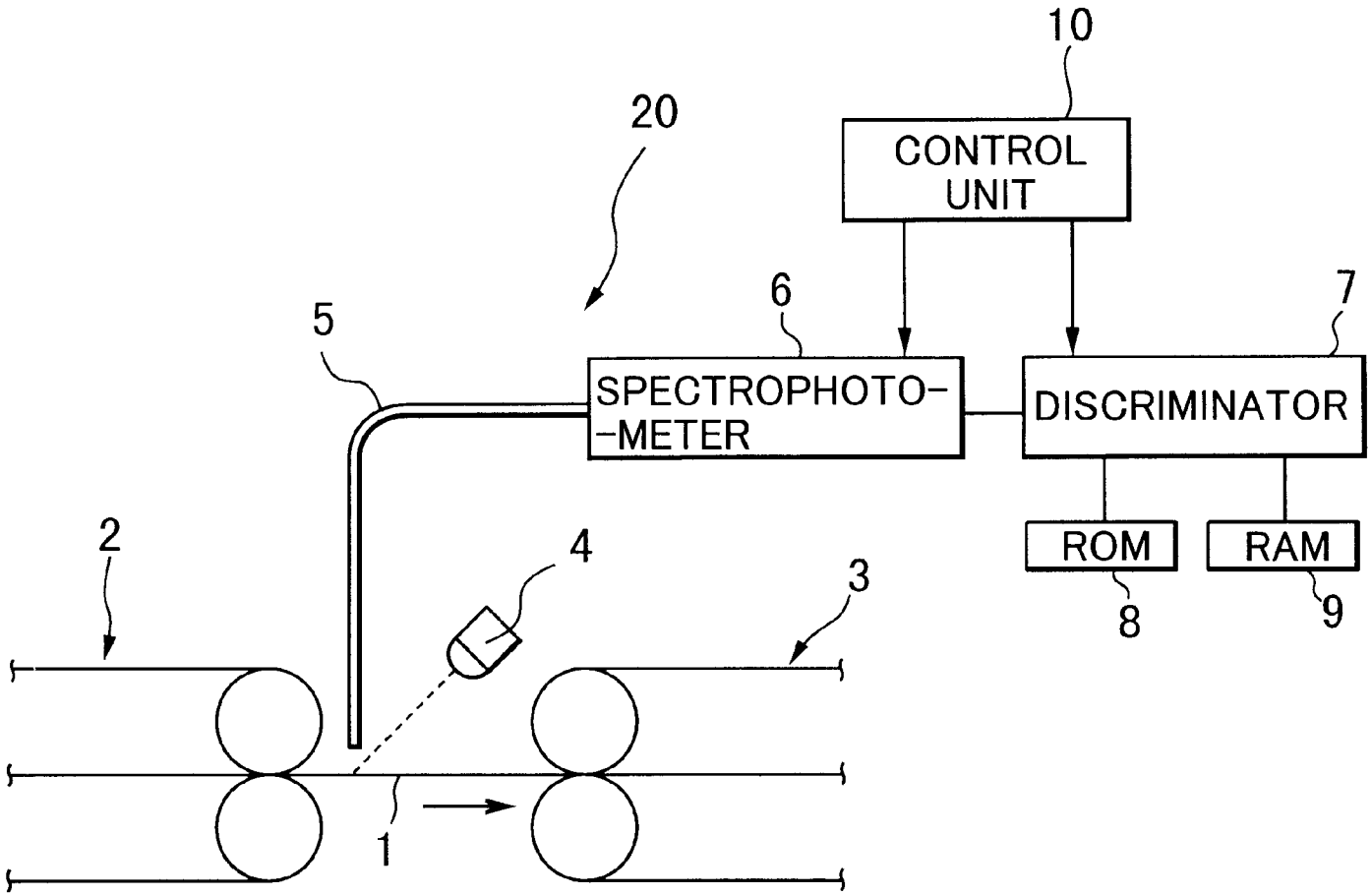
FIG. 1 is a schematic side view showing a bill discriminating apparatus for a bill handling machine which is an embodiment of the present invention.

As shown in FIG. 1, a bill 1 is fed to a bill discriminating apparatus 20 by a conveyor belt means 2 and further fed to a downstream portion in a bill handling machine. The bill discriminating apparatus 20 comprises a light source 4 for emitting light toward the bill 1 at an angle of about 45 degrees with respect to the surface of the bill 1 and an optical fiber 5 for receiving light emitted from the light source 4 and reflected by the bill 1 at one end thereof. The other end of the optical fiber is connected to a spectrophotometer 6. The spectrophotometer 6 is capable of producing spectral data of light received via the optical fiber 5 and the output of the spectrophotometer 6 is connected to discriminator 7. The bill discriminating apparatus 20 further comprises a ROM 8 storing a control program for controlling the whole bill discriminating apparatus 20 and a RAM 9 storing reference data, threshold values and the like. The operation of the bill discriminating apparatus 20 is controlled by a control unit 10.

In this embodiment, spectral data generated by irradiating a non-printed surface portion of a fresh genuine bill with light emitted from the light source 4 and detecting reflected light through the optical fiber 5 by the spectrophotometer 6 are stored in the spectrophotometer 6 as reference spectral data and the spectrophotometer 6 is adapted to generate spectral data of a bill 1 by irradiating a non-printed surface portion of the bill 1 to be discriminated with light emitted from the light source 4 and detecting light reflected from the bill 1 through the optical fiber 5, generate detected data by dividing intensity data of the thus generated spectral data of the bill 1 at each wavelength by intensity data of the reference spectral data at corresponding wavelength to produce intensity ratios and multiplying them by 100, and output the thus generated detected data to the discriminator 7. The RAM 9 stores reference data wherein the intensity ratios at the respective wavelengths are equal to 100%. Since the color of the non-printed surface portion of a fresh genuine bill is generally common among all denominations of bills, it is sufficient to store single set of reference spectral data in the spectrophotometer 6 even in the case where a plurality of denominations of bills are to be discriminated.

The thus constituted bill discriminating apparatus, which is an embodiment of the present invention discriminates bills in the following manner.

The control unit 10 maintains the light source 4 on during the discrimination operation of the genuineness of bills 1. Based on a bill detection signal input from a sensor (not shown) provided upstream of the bill discriminating apparatus 20, the control unit 10 outputs a data production signal to the spectrophotometer 6 at the time the spectrophotometer 6 can receive light reflected from a non-printed surface portion of a bill 1 fed to the bill discriminating apparatus 20 by the conveyor belt means, thereby causing the spectrophotometer 6 to generate spectral data of the received light. The spectrophotometer 6 further divides intensity data of the thus generated spectral data at each wavelength by intensity data of previously stored reference spectral data at the corresponding wavelength to produce intensity ratios and multiplies them by 100 to produce detected data of the bill 1. It outputs the detected data to the discriminator 7.

When the discriminator 7 receives the detected data of the bill 1 from the spectrophotometer 6, it reads out reference data and a threshold value from the RAM 9, compares the detected data of the bill 1 and the reference data and discriminates the genuineness of the bill 1 based on the threshold value.

Figure 2:
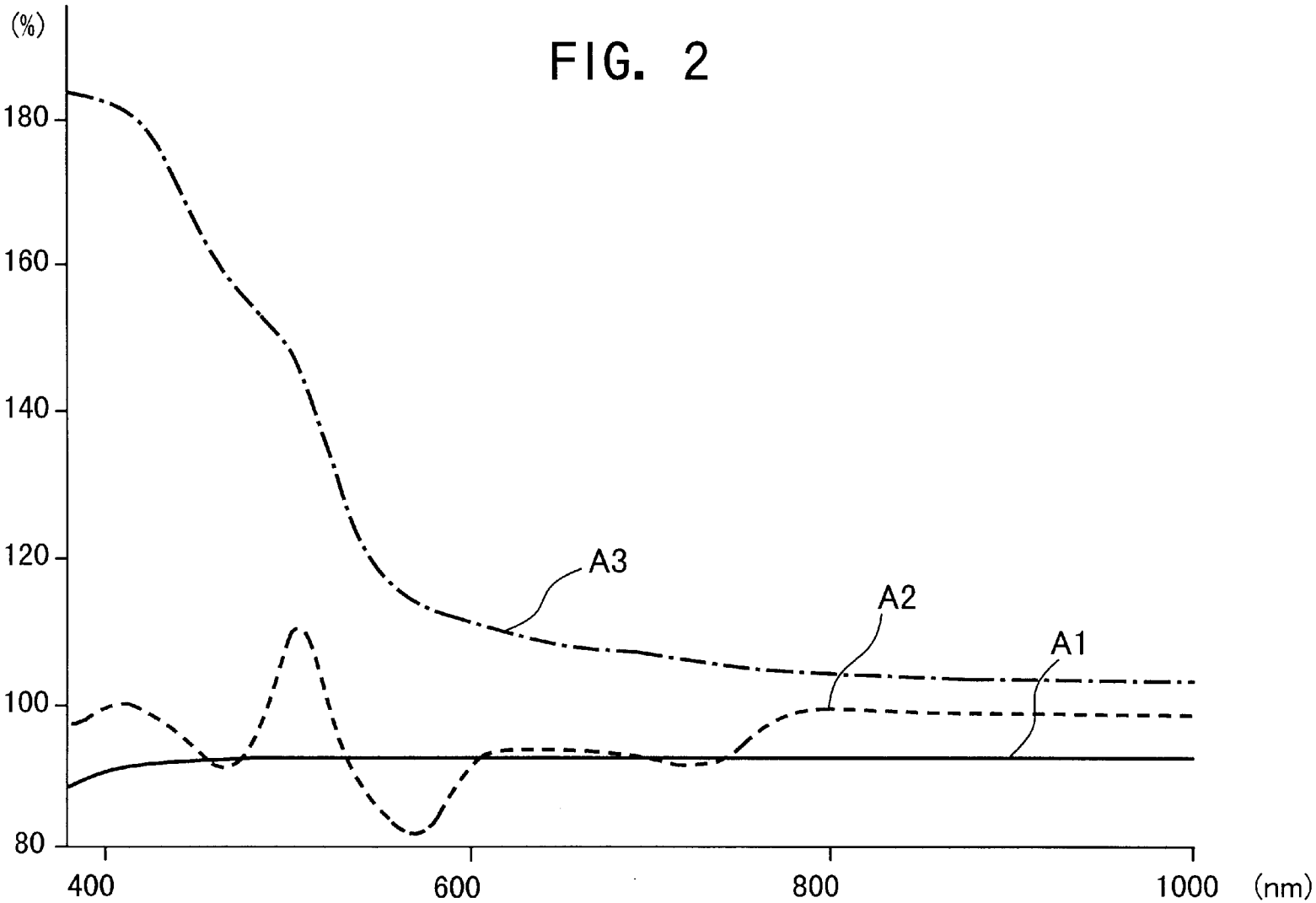
FIG. 2 is a diagram showing examples of detected data output from a spectrophotometer.

FIG. 2 is a diagram showing examples of detected data output by the spectrophotometer 6, wherein the horisontal axis indicates wavelength and the vertical axis indicates intensity ratio.

In FIG. 2, the curve A1 represents detected data of a genuine bill 1, the curve A2 represents detected data of a bill 1 counterfeited using a color printer and the curve A3 represents detected data of white paper.

If a bill 1 is genuine and fresh, the spectral data of the bill 1 are equal to the reference spectral data stored in the spectrophotometer 6 and, therefore, the detected data of the bill 1 equals to 100% over all wavelengths. However, as bills 1 circulate, they become dirty and/or wrinkled. Since a part of light emitted from the light source 4 is reflected diffusely by the dirt or wrinkles, the intensity of the reflected light of the bill 1 is lower than that reflected from a fresh genuine bill 1. Nevertheless, since the intensity of the reflected light substantially uniformly lowers over all wavelengths due to irregular reflection, as indicated by the curve A1, the detected data of a genuine bill 1 becomes a straight line substantially parallel to the horizontal axis.

To the contrary, since background color is printed on the entire surface of a bill 1 counterfeited using a color printer, the spectral data generated by irradiating a non-printed surface portion with light emitted from the light source 4 and detecting light reflected from the thus counterfeited bill 1 via the optical fiber 5 by the spectrophotometer 6 are different from those of a genuine bill 1. Therefore, as indicated by the curve A2, the intensity ratio is high at particular wavelengths but low at other particular wavelengths in the detected data of the bill 1 counterfeited using a color printer.

Further, as indicated by the curve A3, the intensity ratio becomes higher in shorter wavelength regions in the detected data of a white paper.

In view of the above, the discriminator 7 can discriminate the genuineness of bills by comparing the detected data input from the spectrophotometer 6 and the reference data read out from the RAM 9. In this embodiment, the discriminator 7 is constituted so as to discriminate a bill 1 as genuine when the detected data satisfy the following formula over all wavelengths.

$$|1\text{-detected data/reference data}| \leq T1$$

wherein T1 is a threshold value and set to be, for example, 0.2.

According to the above described embodiment, the genuineness of a bill 1 is not discriminated based on particular wavelengths but is discriminated based on the spectral data of the reflected light. Therefore, a counterfeit bill can be discriminated from a genuine bill with high accuracy. Further, the discrimination accuracy can be arbitrarily adjusted by selecting the threshold value T1.

Figure 3:
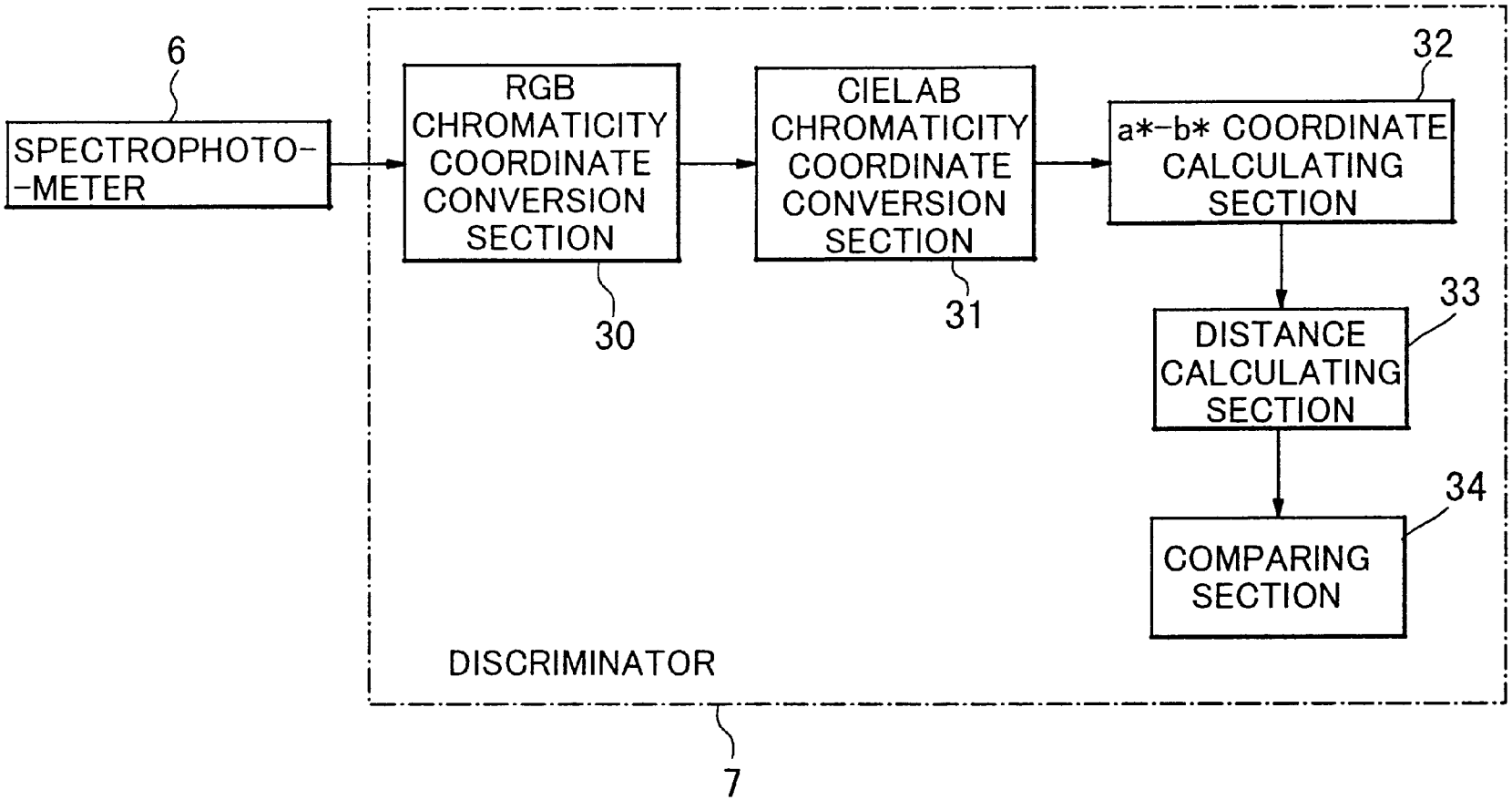
FIG. 3 is a block diagram of discriminator used in another embodiment of the present invention.

FIG. 3 is a block diagram of the discriminator 7 used in another embodiment of the present invention.

As shown in FIG. 3, the discriminator 7 used in another embodiment of the present invention includes an RBG chromaticity coordinate conversion section 30 for converting detected data input from the spectrophotometer 6 into chromaticity coordinates in RGB color space, a CIELAB chromaticity coordinate conversion section 31 for converting chromaticity coordinates in RGB color space into chromaticity coordinates L*, a*, b* in CIELAB color space, a*–b* coordinate calculating section 32 for calculating a*–b* coordinates of the detected data based on the chromaticity coordinates L*, a*, b* in CIELAB color space, a distance calculating section 33 for calculating a distance D between the origin of the a*–b* coordinate system and a point represented by the a*–b* coordinate of the detected data, and a comparing section 34 for comparing the distance D calculated by the distance calculating section 33 with a predetermined distance DT stored in the RAM 9.

Any color can be represented using chromaticity coordinates r, g, b in the RGB color space as below.

$$r=R/(R+G+B)$$

$$g=G/(R+G+B)$$

$$b=B/(R+G+B)$$

In this embodiment, the color of the detected data is first converted by the RGB chromaticity coordinate conversion section 30 into chromaticity coordinates in RGB color space.

However, the area of the MacAdam ellipsis greatly differs depending on color in RGB color space. Therefore, in this embodiment, in order to discriminate the genuineness of a bill 1 with high accuracy based on the color of the bill 1, chromaticity coordinates r, g, b in RGB color space are converted by the CIELAB chromaticity coordinate conversion section 31 in accordance with the following formulae into chromaticity coordinates L*, a*, b* in CIELAB color space in which the area of the MacAdam ellipsis does not greatly differ depending on color.

$$\begin{pmatrix} X \\ Y \\ Z \end{pmatrix} = \begin{pmatrix} 2.7689 & 1.7517 & 1.1302 \\ 1.0000 & 4.5907 & 0.0601 \\ 0.0000 & 0.0565 & 5.5943 \end{pmatrix} \begin{pmatrix} R \\ G \\ B \end{pmatrix}$$

$$L^*=116(Y/Yn)^{1/3}-16$$

$$A^*=500\{(X/Xn)^{1/3}-(Y/Yn)^{1/3}\}$$

$$B^*=200\{(X/Xn)^{1/3}-(Z/Zn)^{1/3}\}$$

wherein Xn, Yn and Zn are tristimulus values when an environment illumination is used.

The a*–b* coordinates of the detected data are then calculated by the a*–b* coordinate calculating section 32. In the case where detected data of a bill 1 are equal to 100% over all wavelengths, namely, in the case of a fresh genuine bill 1 whose spectral data are equal to the reference spectral data, the a*–b* coordinates of the detected data coincide with the origin of the a*–b* coordinate system. The greater the difference between the spectral data of light reflected from a bill 1 and the reference spectral data becomes, namely, the greater the absolute value of the difference between the detected data and 100% becomes, the greater the distance between a point represented by the a*–b* coordinates of the detected data and the origin of the a*–b* coordinate system.

Figure 4:
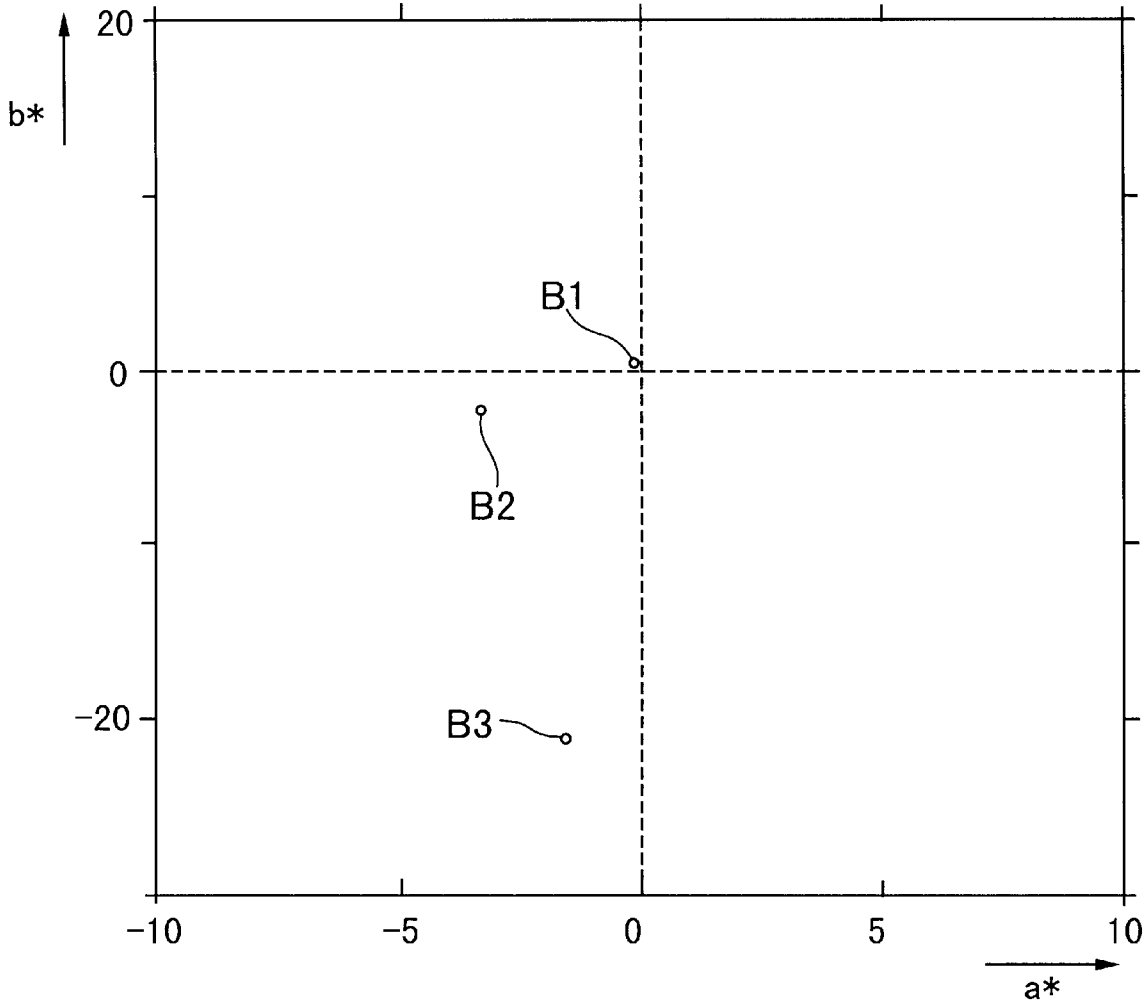
FIG. 4 is a chromaticity diagram indicated in a*–b* coordinate system.

FIG. 4 is a chromaticity diagram indicated in the a*–b* coordinate system wherein BI indicates the point represented by the a*–b* coordinates of detected data of a genuine bill 1, B2 indicates the point represented by the a*–b* coordinates of detected data of a bill 1 counterfeited using a color printer and B3 indicates the point represented by a*–b* coordinates of detected data of white paper. As shown in FIG. 4, the point B1 of detected data of a genuine bill 1 substantially coincide with the origin of the a*–b* coordinate system.

Therefore, the distance D between the origin of the a*–b* coordinate system and the point represented by the coordinates (a*, b*) of detected data is calculated by the distance calculating section 33 to be output to the comparing section 34.

The comparing section 34 compares the distance D between the origin of the a*–b* coordinate system and the point represented by the coordinates (a*, b*) of detected data input from the distance calculating section 33 with a predetermined distance DT which is a threshold value and read out from the RAM 9 and discriminates that the bill 1 is genuine when the following formula is satisfied.

$$D \leq DT$$

Therefore, if the threshold value DT is experimentarily determined so that only the distance D between the point represented by the coordinate (a*, b*) of detected data of the genuine bill 1 and the origin of the a*–b* coordinate system is set to be equal to or smaller than the threshold value DT and stored in the RAM 9, it is possible to discriminate the genuineness of a bill 1.

According to the above described embodiment, since the genuineness of a bill 1 is discriminated based on the point represented by chromaticity coordinates, a counterfeit bill can be discriminated from a genuine bill with high accuracy. Further, the discrimination accuracy can be arbitrarily adjusted by selecting the threshold value DT.

Figure 5:
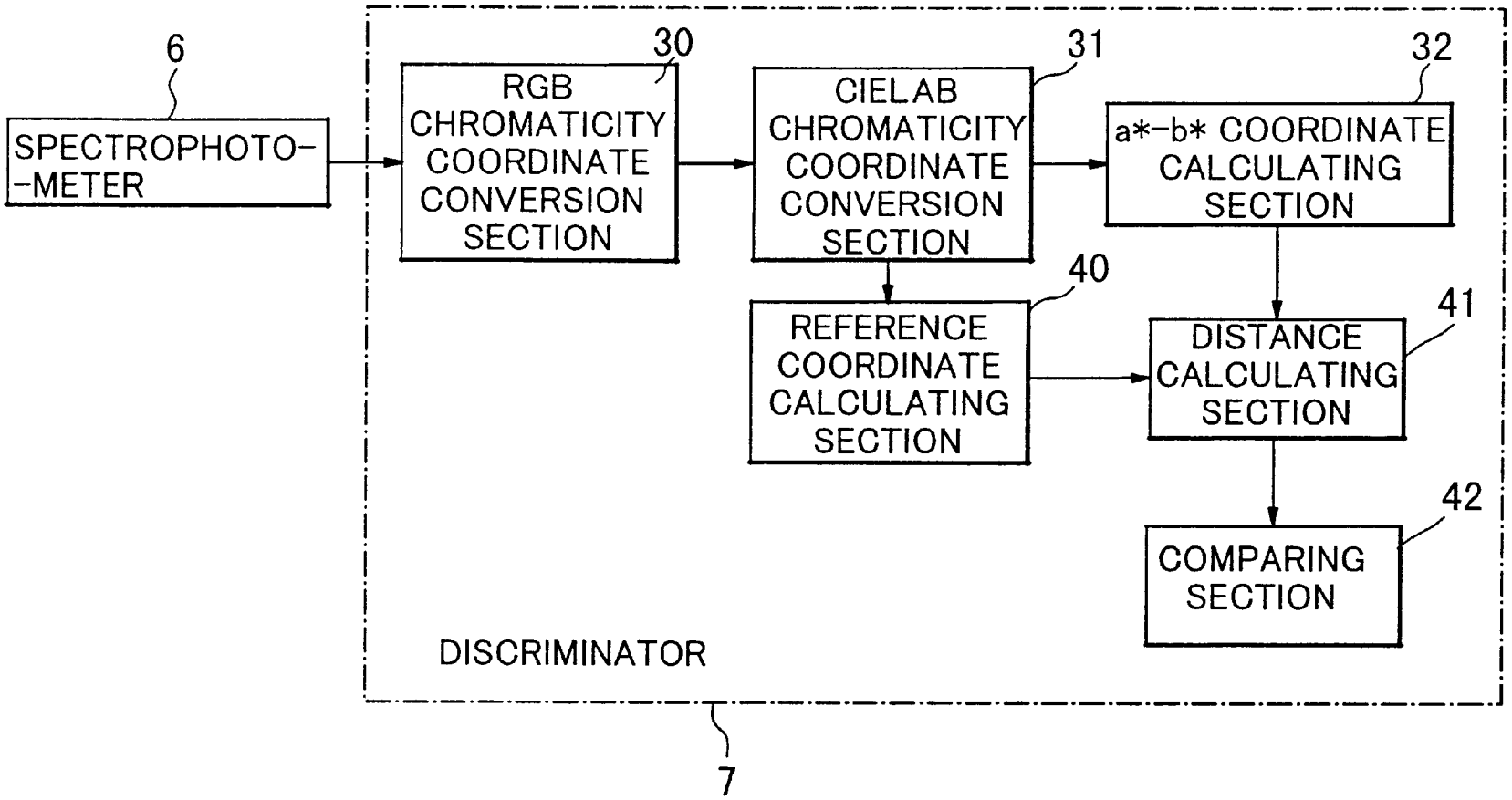
FIG. 5 is a block diagram of discriminator used in a further embodiment of the present invention.

FIG. 5 is a block diagram of the discriminator 7 used in a further embodiment of the present invention.

As shown in FIG. 5, the discriminator 7 according to this embodiment includes, in addition to the discriminator 7 shown in FIG. 3, a reference coordinate calculating section 40 for calculating reference coordinates (a*0, b*0) of detected data which are used as a reference and instead of the distance calculating section 33 and the comparing section 34 of the discriminator 7 shown in FIG. 3, includes a distance calculating section 41 for calculating a distance D between a point represented by the reference coordinates (a*0, b*0) calculated by the reference coordinate calculating section 40 and a point represented by coordinates (a*, b*) of detected data and a comparing section 42 for comparing the distance D calculated by the distance calculating section 41 and a predetermined distance DT.

In this embodiment, the spectrophotometer 6 does not store, as reference spectral data, spectral data generated by irradiating a non-printed surface portion of a fresh genuine bill 1 with light emitted from the light source 4 and detecting light reflected from the bill 1 via the optical fiber 5 but stores spectral data generated by irradiating a white paper with light emitted from the light source 4 and detecting light reflected from the white paper via the optical fiber 5 as reference spectral data. Therefore, even if detected data are generated by irradiating a non-printed surface portion of a genuine bill 1 with light emitted from the light source 4 and detecting light reflected from the bill 1 via the optical fiber 5 to produce spectral data, dividing the intensity data of the thus produced spectral data at each wavelength by the intensity data of the reference spectral data at the corresponding wavelength to generate intensity ratios and multiplying them by 100, the detected data cannot be shown by a straight line substantially parallel to the horizontal axis in FIG. 2. As a result, a point represented by the coordinates (a*, b*) of detected data does not lie in the vicinity of the origin of the a*–b* coordinate system but lies apart from the origin of the a*–b* coordinate system. Therefore, it is impossible to discriminate the genuineness of a bill 1 depending upon whether or not the distance D between the point represented by the coordinate (a*, b*) of detected data and the origin of the a*–b* coordinate system is equal to or smaller than the threshold value DT.

In view of the above, in this embodiment, spectral data are first produced by irradiating a non-printed surface portion of a fresh genuine bill 1 with light emitted from the light source 4 and causing the spectrophotometer 6 to detect light reflected from the bill 1 via the optical fiber 5 and reference detected data to be used as a reference are produced by dividing the intensity data of the thus produced spectral data at each wavelength by the intensity data of the reference spectral data at the corresponding wavelength to generate intensity ratios and multiplying them by 100. Color of the reference detected data is then converted by the RBG chromaticity coordinate conversion section 30 into chromaticity coordinates in the RGB color space, the thus obtained chromaticity coordinates r, g, b in the RGB color space are converted by the CIELAB chromaticity coordinate conversion section 31 into chromaticity coordinates L*, a*, b* in the CIELAB color space and reference coordinates (a*0, b*0) of the reference detected data are further calculated by the reference coordinate calculating section 40.

The thus calculated reference coordinates (a*0, b*0) correspond to the detected data produced by irradiating a non-printed surface portion of a fresh genuine bill 1 with light emitted from the light source 4, causing spectrophotometer 6 to detect light reflected from the bill 1 via the optical fiber 5 to generate spectral data, dividing the intensity data of the thus produced spectral data at each wavelength by the intensity data of the reference spectral data at the corresponding wavelength to generate intensity ratios and multiplying them by 100. Therefore, as even genuine bills 1 becomes dirty and/or wrinkled during circulation and since a part of the light emitted from the light source 4 is reflected diffusely by the dirt or wrinkles, the intensity of the reflected light of the bill 1 is lower than that reflected from a fresh genuine bill 1. As a result, the coordinates (a*, b*) of detected data of a genuine bill 1 does not always coincide with the reference coordinates (a*0, b*0) but the point represented by the coordinates (a*, b*) lies within a predetermined distance DT from the point represented by the reference coordinates (a*0, b*0).

In view of the above, the distance calculating section 41 calculates the distance D between the point represented by the reference coordinates (a*0, b*0) calculated by the reference coordinate calculating section 40 and the point represented by the coordinates (a*, b*) of detected data and outputs it to the comparing section 42.

The comparing section 42 compares the distance D calculated by the distance calculating section 41 with a predetermined distance DT read out from the RAM 9 and when the following formula is satisfied, it discriminates that the bill 1 is genuine.

$$D \leq DT$$

Figure 6:
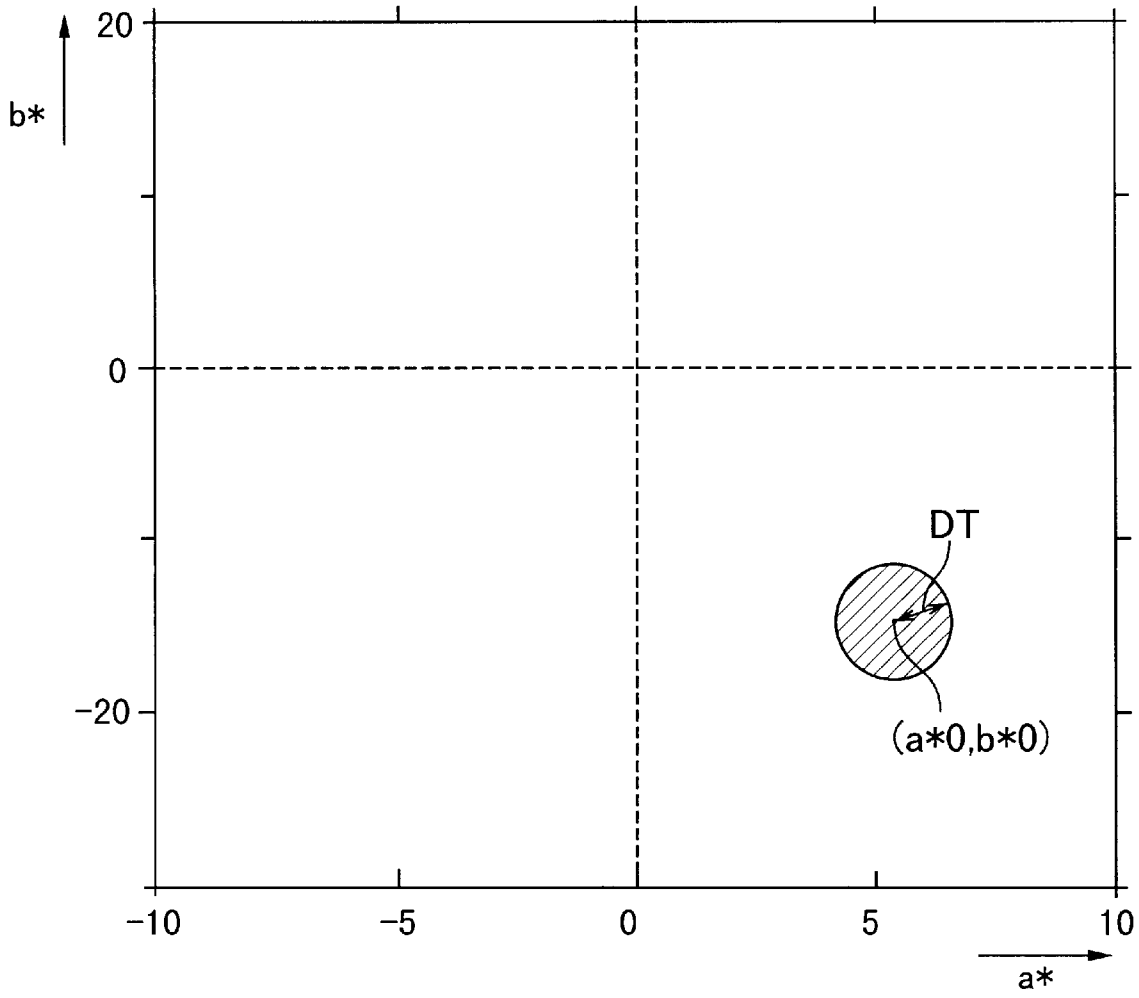
FIG. 6 is a chromaticity diagram indicated in a*b* coordinate system.

Therefore, if the threshold value DT is experimentarily determined so that only the distance D between the point represented by the coordinates (a*, b*) of detected data of the genuine bill 1 and the point represented by the reference coordinates (a*0, b*0) is set to be equal to or smaller than the threshold value DT and stored in the RAM 9, it is possible to discriminate the genuineness of a bill 1. FIG. 6 is a chromaticity diagram indicated in a*b* coordinate system.

According to the above described embodiment, since the genuineness of a bill 1 is discriminated based on chromaticity coordinates, a counterfeit bill can be discriminated from a genuine bill with high accuracy. Further, the discrimination accuracy can be arbitrarily adjusted by selecting the threshold value DT.

Figure 7:
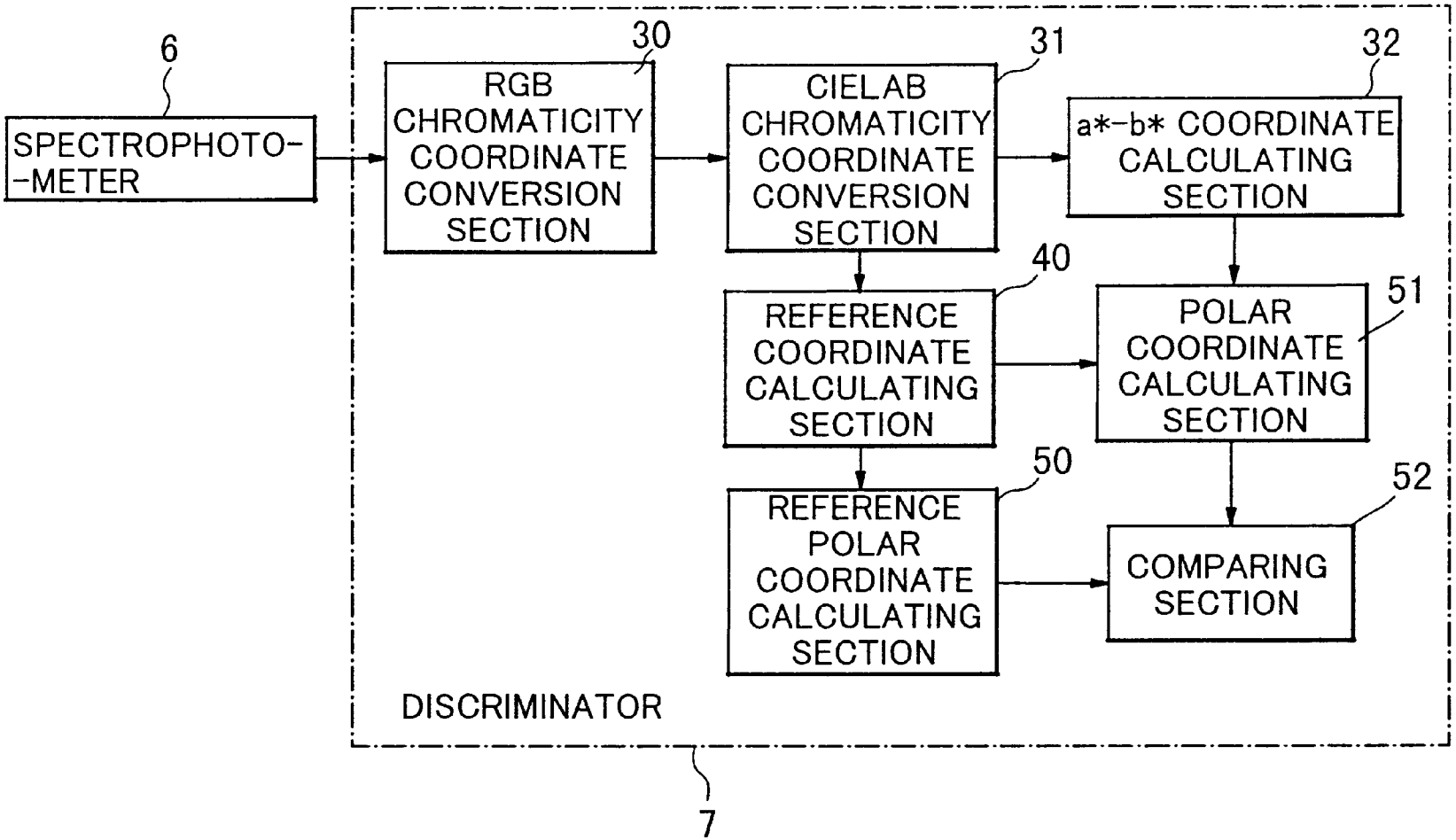
FIG. 7 is a block diagram of discriminator used in a further embodiment of the present invention.

FIG. 7 is a block diagram of the discriminator 7 used in a further embodiment of the present invention.

As shown in FIG. 7, the discriminator 7 according to this embodiment includes, in addition to the discriminator 7 shown in FIG. 5, a reference polar coordinate calculating section 50 for converting the reference coordinates (a*0, b*0) into polar coordinates and calculating reference polar coordinates and instead of the distance calculating section 41, includes a polar coordinate conversion section 51 for converting a*–b* coordinates of detected data into polar coordinates and a comparing section 52 that serves to discriminate the genuineness of a bill 1 by comparing the reference polar coordinates and the polar coordinates of the detected data.

Similarly to the previous embodiment shown in FIG. 5, in this embodiment, the spectrophotometer 6 does not store, as reference spectral data, spectral data generated by irradiating a non-printed surface portion of a fresh genuine bill 1 with light emitted from the light source 4 and detecting light reflected from the bill 1 via the optical fiber 5 but stores spectral data generated by irradiating a white paper with light emitted from the light source 4 and detecting light reflected from the white paper via the optical fiber 5 as reference spectral data.

Therefore, in a similar manner to the embodiment shown in FIG. 5, reference coordinates (a*0, b*0) of the reference detected data are calculated by the reference coordinate calculating section 40.

The reference coordinates (a*0, b*0) are converted by the reference polar coordinate calculating section 50 based on the following formulae into polar coordinates, whereby reference polar coordinates (r0, θ0) are calculated.

$$r0=(a^{*0^2}+b0^{*2})^{1/2}$$

$$\theta 0=\tan^{-1}(b^{*}0/a^{*}0)$$

Similarly to the previous embodiment, a*–b* coordinates of detected data are calculated and converted by the polar coordinate conversion section 51 based on following formulae.

$$R=(a^{*2}+b^{*2})^{1/2}$$

$$\theta=\tan^{-1}(b^{*}/a^{*})$$

As even genuine bills 1 becomes dirty and/or wrinkled during circulation and since a part of light emitted from the light source 4 is reflected diffusely by the dirt or wrinkles, the intensity of the reflected light of the bill 1 is lower than that reflected from a fresh genuine bill 1. As a result, the polar coordinates (r, θ) of detected data of a genuine bill 1 does not always coincide with the reference polar coordinates (r0, θ0) but the point represented by the polar coordinates (r, θ) lies within a predetermined range from the point represented by the reference polar coordinates (r0, θ0). Therefore, the comparing section 52 can discriminate the genuineness of a bill 1 depending upon whether the following formulae are satisfied.

$$|r0-r| \leqq rT$$

$$|\theta 0-\theta| \leqq \theta T$$

wherein rT and θT are threshold values and stored in the RAM 9.

According to the above described embodiment, since the genuineness of a bill 1 is discriminated based on chromaticity coordinates, a counterfeit bill can be discriminated from a genuine bill with high accuracy. Further, the discrimination accuracy can be arbitrarily adjusted by selecting the threshold values rT and θT.

The present invention has thus been shown and described with reference to a specific embodiment. However, it should be noted that the present invention is in no way limited to the details of the described arrangements but changes and modifications may be made without departing from the scope of the appended claims.

For example, in the above described embodiments, although explanation is made as to discrimination of the genuineness of a bill 1, the present invention can not only be effectively applied to discriminate the genuineness of bills but also be widely applied to discriminate the genuineness of security certificates and various other sheets.

Further, in the above described embodiments, the genuineness of a bill 1 is discriminated by generating spectral data by irradiating a non-printed surface portion of a bill 1 with light emitted from the light source 4 and causing the spectrophotometer 6 to detect light reflected from the bill 1 via the optical fiber 5, generating detected data by dividing intensity data of the spectral data of the bill 1 at each wavelength by intensity data of the reference spectral data at corresponding wavelength to produce intensity ratios and multiplying them by 100, and comparing the thus generated detected data with the reference data in the discriminator 7. However, the genuineness of a bill 1 may be discriminated by storing spectral data of a genuine bill 1 in the RAM 9 as reference data, outputting spectral data of a bill 1 generated by the spectrophotometer 6 to the discriminator 7 without using reference spectral data and comparing the spectral data of the bill 1 with the reference data stored in the RAM 9.

Moreover, in the above described embodiments, although the reference spectral data is generated using a fresh genuine bill 1, it is not absolutely necessary to use a fresh genuine bill 1 but sufficient to use a genuine bill 1 for generating the reference spectral data.

Furthermore, in the embodiments shown in FIGS. 5 and 7, although the reference spectral data is generated using a white paper, it is not necessary to use white paper but possible to use any other sheet for generating the reference spectral data.

Moreover, in the above described embodiments, although the reference data and the threshold values are stored in the RAM 9, all or parts of them may be stored in the ROM 8.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a sheet discriminating apparatus which can accurately discriminate the genuineness of a sheet, particularly a bill or security certificate.

What is claimed is:

1. A sheet discriminating apparatus comprising a light source for emitting light toward a bill, light receiving means for receiving light emitted from the light source and reflected by a non-printed surface portion of the bill and generating spectral data, memory means for storing reference data, and discriminating means for discriminating genuineness of the bill based on the spectral data generated by the light receiving means and the reference data stored in the memory means, said light receiving means storing in advance spectral reference data, generating detected data by dividing intensity data of the reference spectral data of the bill at each wavelength by intensity data of the reference spectral data at the corresponding wavelength and outputting the detected data to the discriminating means, and the discriminating means further comprising chromaticity coordinate conversion means for converting the detected data into chromaticity coordinates so as to discriminate the genuineness of the bill based on the detected data converted by the chromaticity coordinate conversion means.

2. A sheet discriminating means in accordance with claim 1 wherein the discriminating means comprises distance calculating means for calculating a distance between a point represented by the chromaticity coordinates of the detected data converted by the chromaticity coordinate conversion means and the origin of the chromaticity coordinate system, and the discriminating means discriminates the genuineness of the bill based on the distance between the point represented by the chromaticity coordinates of the detected data converted by the chromaticity coordinate conversion means and the origin of the chromaticity coordinate system.

3. A sheet discriminating apparatus in accordance with claim 1 wherein the discriminating means discriminates the genuineness of the bill based on the chromaticity coordinates of the detected data converted by the chromaticity coordinate conversion means and the chromaticity coordinates of reference detected data obtained by dividing intensity data of spectral data of a genuine bill at each wavelength by intensity data of the reference spectral data at the corresponding wavelength.

4. A sheet discriminating apparatus in accordance with claim 3 wherein the discriminating means further comprises distance calculating means for calculating a distance between a point represented by the chroma icity coordinates of the detected data converted by the chromaticity coordinate conversion means and a point represented by the chromaticity coordinates of reference detected data, and the discriminating means discriminates the genuineness of the bill based on the distance between the point represented by the chromaticity coordinates of the detected data and the point represented by the chromaticity coordinates of reference detected data calculated by the distance calculating means.

5. A sheet discriminating apparatus in accordance with claim 3 wherein the discriminating means further comprises reference polar coordinate conversion means for converting the chromaticity coordinates of the reference detected data into polar coordinates, polar coordinate conversion means for converting the chromaticity coordinates of the detected data converted by the chromaticity coordinate conversion means into polar coordinates, and comparing means for discriminating the genuineness of the bill based on the polar coordinates of the reference detected data converted by the reference polar coordinate conversion means and the polar coordinates of the detected data converted by the polar coordinate conversion means.

6. A sheet discriminating apparatus in accordance with claim 1 wherein the light receiving means is constituted as a spectrophotometer.

7. A sheet discriminating apparatus in accordance with claim 2 wherein the light receiving means is constituted as a spectrophotometer.

8. A sheet discriminating apparatus in accordance with claim 3 wherein the light receiving means is constituted as a spectrophotometer.

9. A sheet discriminating apparatus in accordance with claim 4 wherein the light receiving means is constituted as a spectrophotometer.

10. A sheet discriminating apparatus in accordance with claim 5 wherein the light receiving means is constituted as a spectrophotometer.

11. A sheet discriminating apparatus in accordance with claim 1 wherein the sheet is selected from a group consisting of a bill and security certificate.

12. A sheet discriminating apparatus in accordance with claim 2 wherein the sheet is selected from a group consisting of a bill and security certificate.

13. A sheet discriminating apparatus in accordance with claim 3 wherein the sheet is selected from a group consisting of a bill and security certificate.

14. A sheet discriminating apparatus in accordance with claim 4 wherein the sheet is selected from a group consisting of a bill and security certificate.

15. A sheet discriminating apparatus in accordance with claim 5 wherein the sheet is selected from a group consisting of a bill and security certificate.

16. A sheet discriminating apparatus in accordance with claim 6 wherein the sheet is selected from a group consisting of a bill and security certificate.

17. A sheet discriminating apparatus in accordance with claim 7 wherein the sheet is selected from a group consisting of a bill and security certificate.

18. A sheet discriminating apparatus in accordance with claim 8 wherein the sheet is selected from a group consisting of a bill and security certificate.

19. A sheet discriminating apparatus in accordance with claim 9 wherein the sheet is selected from a group consisting of a bill and security certificate.

20. A sheet discriminating apparatus in accordance with claim 10 wherein the sheet is selected from a group consisting of a bill and security certificate.

* * * * *